US005204688A

United States Patent [19]

Loiseau et al.

[11] Patent Number: 5,204,688

[45] Date of Patent: Apr. 20, 1993

[54] OMNIDIRECTIONAL ANTENNA NOTABLY FOR THE EMISSION OF RADIO OR TELEVISION BROADCASTING SIGNALS IN THE DECIMETRIC WAVEBAND, AND RADIATING SYSTEM FORMED BY A GROUPING OF THESE ANTENNAS

[75] Inventors: Maurice Loiseau, Courbevoie; Guy Bastard, Garches, both of France

[73] Assignee: Thomson-LGT Laboratoire General des Telecommunications, Conflas Ste Honorine, France

[21] Appl. No.: 703,055

[22] Filed: May 17, 1991

Related U.S. Application Data

[63] Continuation of Ser. No. 381,787, Jul. 19, 1989, abandoned.

[30] Foreign Application Priority Data

Jul. 22, 1988 [FR] France ..... 88 09940

[51] Int. Cl.[5] ..... H01Q 21/12

[52] U.S. Cl. ..... 343/800; 343/814; 343/816; 343/891

[58] Field of Search ..... 343/800, 890, 891, 799, 343/820, 810, 812, 814, 816

[56] References Cited

U.S. PATENT DOCUMENTS

| | | | |
|---|---|---|---|
| 2,212,625 | 8/1940 | Thomas | 343/800 |
| 2,539,433 | 1/1951 | Kandoian | 343/800 |
| 2,688,081 | 8/1954 | Laport | 343/799 |
| 2,771,606 | 11/1956 | Kandoian | 343/890 |
| 3,329,959 | 7/1967 | Laub et al. | 343/800 |
| 3,475,758 | 10/1969 | De Vito | 343/799 |
| 4,031,536 | 6/1977 | Alford | 343/890 |
| 4,446,465 | 5/1984 | Donovan | 343/800 |

FOREIGN PATENT DOCUMENTS

| | | | |
|---|---|---|---|
| T6860 | 2/1956 | Fed. Rep. of Germany | 343/799 |
| 939093 | 2/1956 | Fed. Rep. of Germany | 343/800 |
| 1085204 | 1/1960 | Fed. Rep. of Germany | 343/799 |
| 1117667 | 11/1961 | Fed. Rep. of Germany | 343/800 |
| 1134121 | 8/1962 | Fed. Rep. of Germany | 343/800 |
| 487708 | 6/2438 | United Kingdom . | |

OTHER PUBLICATIONS

Review of the Electrical Communication Laboratories, vol. 30 (1982) Mar., No. 2, Tokyo, Japan, pp. 272–278, T. Nagatsu, et al.

*Primary Examiner*—Michael C. Wimer

*Attorney, Agent, or Firm*—Oblon, Spivak, McClelland, Maier & Neustadt

[57] ABSTRACT

The disclosed antenna is designed notably for the emission of television and radio broadcast signals in the decimetrical wavebands. It comprises:

a vertical, central supporting tube, a plurality of identical radiating networks evenly distributed around the central tube, each consisting of a vertical bifilary line symmetrically supplying, supporting and coupling a plurality of horizontal dipoles evenly distributed along this bifilary line, and, a system for the distribution of equiphase, equal power, identically and simultaneously supplying the radiating networks through a single coaxial supply line. The antenna has a reflector thus substantially reducing its weight and its windward surface as compared with standard antennas with panels generally used in this band. Advantageously, these antennas are superimposed and enclosed in a sealed radome which is substantially cylindrical and self-supporting and superimposable. This antenna gives an omnidirectional diagram with 0.9 dB between 460 and 860 MHz and can radiate 5 to 7 kW per antenna element.

12 Claims, 4 Drawing Sheets

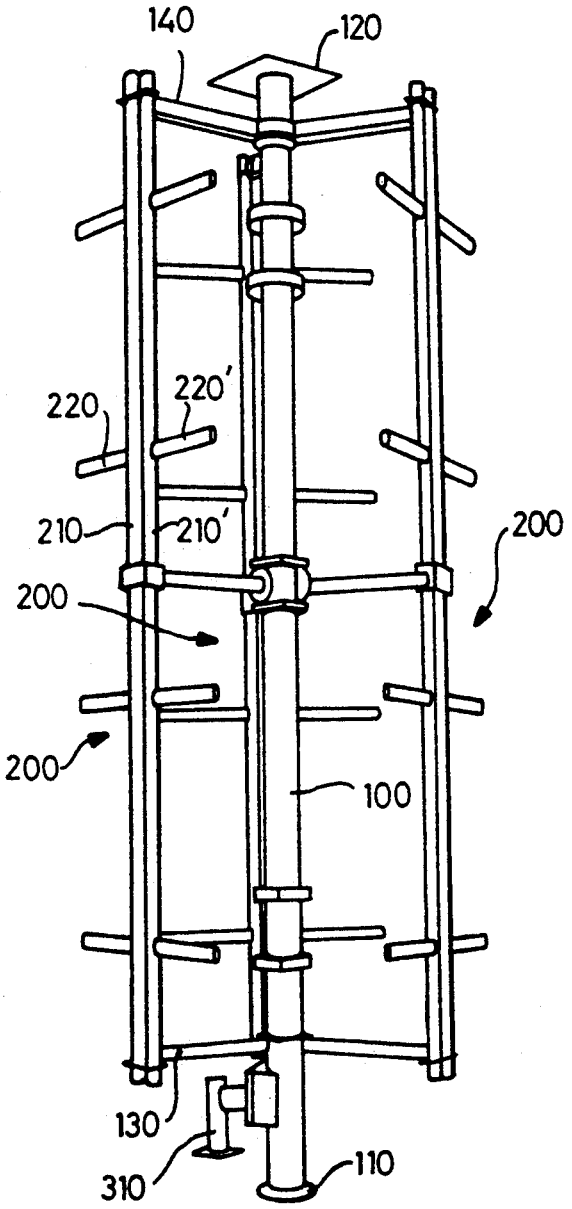
FIG_1
FIG_2
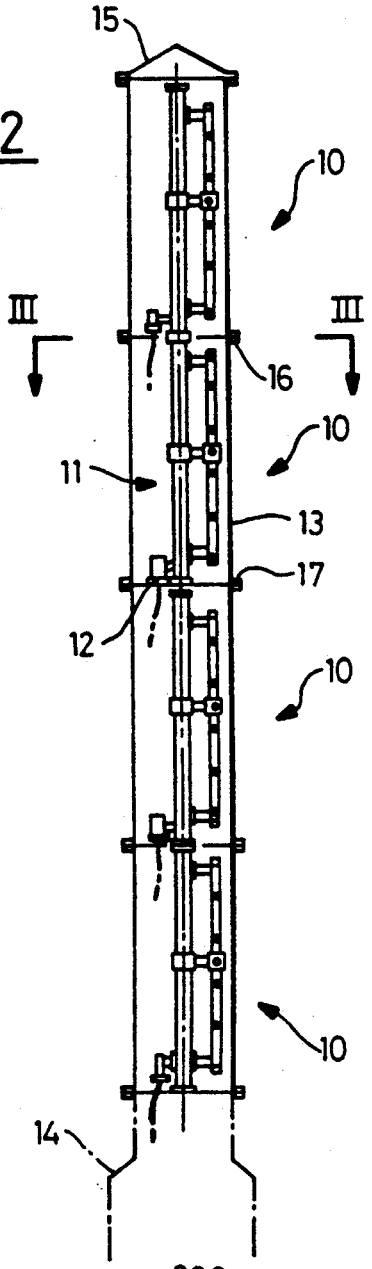
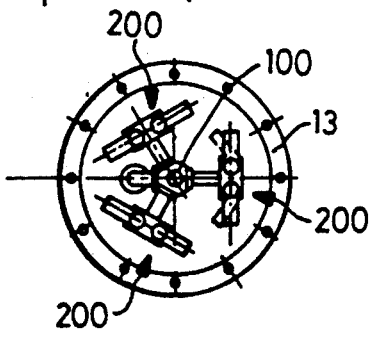
FIG_3

OMNIDIRECTIONAL ANTENNA NOTABLY FOR THE EMISSION OF RADIO OR TELEVISION BROADCASTING SIGNALS IN THE DECIMETRIC WAVEBAND, AND RADIATING SYSTEM FORMED BY A GROUPING OF THESE ANTENNAS

This application is a continuation, of application Ser. No. 07/381,787, filed on Jul. 19, 1989, now abandoned.

BACKGROUND OF THE INVENTION

1. Field of the Invention

The present invention concerns an omnidirectional antenna. This antenna can be applied especially to the transmission of radio or television broadcasting signals in the decimetric wavebands (the so-called microwave band) where it will be seen that it gives particularly worthwhile advantages.

However, the invention is limited neither to this application nor to this band of frequencies, and could also be suited to a wide variety of different situations.

2. Description of the Prior Art

For radio or television broadcasting antennas, there should be (barring exceptions) a radiating system having a diagram that is as omnidirectional as possible (the term "omnidirectional diagram" refers to a diagram that has no trough of less than 3 dB over 360 degrees).

This system should further have mechanical characteristics of compactness and lightness, enabling it to be placed at the top of a mast in minimizing both the static load (the inherent load of the radiating system) as well as the dynamic load (wind resistance) borne by the mast.

To this effect, it is most common to use an antenna system called a "panel antenna" formed with radiating elements, each consisting of a dipole placed before a reflector, the dipole being oriented vertically or horizontally depending on the desired polarization.

Since a radiating element such as this is an element with gain, hence a directional element, it has to be arranged in sets of four elements at angles of 90° with respect to one another, to obtain the desired omnidirectional diagrams.

To increase the admissible power, a plurality of these radiating elements (most usually 2, 4 or 8 radiating elements) are superimposed so as to form radiating panels, the reflector most usually being common.

Each panel is powered separately with the same phase and the same power as all the others (unless it is sought to play on the form of the diagram in introducing phase shifts or power variations) by means of a distributor set.

Although this configuration works satisfactorily in a great number of present-day emitting stations, it has a number of drawbacks.

First of all, at the top of the mast itself, there should be provision for a small pylon enabling the appropriate arrangement of the superimposed radiating elements forming the four radiating faces of the configuration.

This element should meet two contradictory conditions:

firstly, its dimensions should be sufficient to enable the installation of supplies for each panel and enable a man to pass through the center of the configuration so that it is possible to provide for its maintenance. It has been noted, in effect, that each radiating element is supplied by its own coaxial cable and, since this coaxial cable necessarily has to be placed behind the reflecting panel of the radiating element so that it does not disturb its operation, the harness of coaxial cables will have to go through the inside of the small pylon which would therefore have to be high enough (for faces with 8 superimposed radiating elements, we thus have 32 coaxial cables to be inserted into this small pylon).

For this kind of ease of installation and also for sound mechanical rigidity, it is therefore desirable for the structure of the small pylon to be as wide as possible;

secondly, from the radio-electrical point of view, the troughs in the diagram get accentuated as and when the phase centers of the radiating elements get further away.

To obtain the most regular of diagrams possible, it is therefore desirable to bring the radiating elements of each group as close together as possible, and hence to provide for a small pylon section which is as small as possible (and at the same time restricted by the minimum dimension of the reflectors).

To reduce the above-mentioned static load and dynamic load to the minimum, it is also desirable to reduce the section of the small pylon to the minimum, all the more so as the radiating set should be shielded by a radome, the size of which, given the dimension of the radiating elements, will have a very large windward area and will therefore exert all the more force on the mast.

Another drawback of this type of antenna results from the complexity of its supply system (each of the radiating elements has to be supplied by its own coaxial cable as indicated above), and this makes it necessary to provide for a large number of secondary coaxial supply cables and connection boxes. The cost price of an antenna system such as this will thus increase very quickly with the number of radiating elements used.

Furthermore, the losses will increase very quickly, both because of the increase in the number of connection boxes and because of the lengthening of the secondary supply coaxial cables. Typically for a radiating system with a panel having eight superimposed radiating elements dimensioned for the 470–860 MHz band, the height of the small pylon and therefore, of the longest coaxial cables is of the order of 12 meters, thus creating considerable losses in a range of frequencies such as this.

Thus, typically, we arrive at small pylon sections of the order of $0.8\times0.8$ m. and radome diameters of the order of 1 meter for transmission in the 470–860 MHz band, one group of four panels with its radome having a mass of 350 to 400 kg. and having a windward surface of the order of 1.3 $m^2$.

Another type of antenna suited to the above-mentioned use, although less used, is the so-called super turnstile antenna.

In this type of antenna, to obtain the desired omnidirectional diagram, the principle of the rotating field is used, and the radiating element then consists of two flat, vertical and mutually perpendicular "bat wings" intersecting at their center and mutually phase shifted by 90°.

Thus, a large number of radiating elements is superimposed, and each radiating element is supplied separately through a common distributor system and the two dipoles formed by the "bat wings" of each radiating element are supplied in quadrature non-periodically by a 3 Db coupler.

Although this type of antenna has a far smaller overall diameter than that of a system using antenna panels because of the absence of any reflector, it makes it possible to considerably reduce the dimensions of the small pylon, it has a certain number of drawbacks:

first of all, the need to achieve the non-periodic supply in quadrature between the dipoles causes the use of 3 dB couplers placed in the radiation field, the balancing charge of the coupler having to be dimensioned as a function of the power to be emitted;

then, the coaxial supply cables of the dipoles are located in the field of radiation of the antenna and, therefore, disturb its radiation by creating troughs in the diagram;

furthermore, for equal gain, the total height of the antenna is greater than that of an antenna with radiating elements, further causing correlative problems of compensation of the diagram in elevation for antennas with a large number of radiating elements;

finally, its cost price is very high because of the mechanical complexity, the presence of 3 dB couplers and the large number of coaxial supply cables used.

As can be seen, therefore, the two types of antennas used up till now for radio or television broadcasting emitters in the decimetric wavelengths are not entirely satisfactory because they cannot be used simultaneously to achieve both mechanical performances (compactness to restrict the windward surface, low weight and a structure that is easy to manufacture) as well as radio-electrical characteristics (omnidirectional nature of the diagram and the possibility of accepting high power) desired.

SUMMARY OF THE INVENTION

The present invention proposes to resolve these drawbacks in proposing a new type of antenna which, while having excellent radio-electrical properties, is compact and light, and can be made at low cost through its simple mechanical structure (notably the lack of small pylons) and the reduction of coaxial cable connections to the minimum.

To this effect, the antenna according to the invention has:

a vertical central supporting tube, a plurality of identical radiating networks evenly distributed around the central tube, each consisting of a vertical bifilary line symmetrically supplying, coupling and supporting a plurality of horizontal dipoles evenly distributed along this bifilary line, and, a system for the distribution of equiphase, equal-power power, identically and simultaneously supplying the radiating networks through a single coaxial supply line.

According to a certain number of advantageous characteristics of the invention:

there are three radiating networks;

each radiating network has four horizontal dipoles;

the dipoles are of the shortened half-wave type, computed on the central operating frequency of the antenna with a shortening coefficient of about 0.9; the distance between two superimposed, consecutive dipoles is one shortened half-wave computed for the central operating frequency of the antenna with a coefficient of about 0.85, and the distance of the dipoles from the central axis of the system is one non-shortened quarter-wave computed for the central operating frequency of the system;

the power distribution system is entirely housed within the central supporting tube;

the bifilary line has a lower half and an upper half, and each of these halves is excited, at a point located at mid-height, by a coaxial line passing within one of the conductors of the bifilary line, said line being itself connected to the power distribution system located in the central supporting tube, approximately at the connection of the two halves of each bifilary line;

each branch of the dipole has a substantially circular curve, the center of curvature of which is located approximately on the central axis of the antenna.

BRIEF DESCRIPTION OF THE DRAWINGS

Other features and advantages of the invention will appear from the following detailed description, made with reference to the appended figures, of which:

FIG. 1 is a view in perspective of a radiating set forming the antenna according to the invention;

FIG. 2 shows a plurality of these radiating sets, superimposed and coupled so as to increase the radiated power, the set being shielded by an external radome;

FIG. 3 is a sectional view, along the line III—III, of FIG. 2 showing the radiating set of the present invention seen from on top;

In all the figures, the same numerical references are repeated for similar elements.

DETAILED DESCRIPTION OF THE PREFERRED EMBODIMENT

Figure 4:
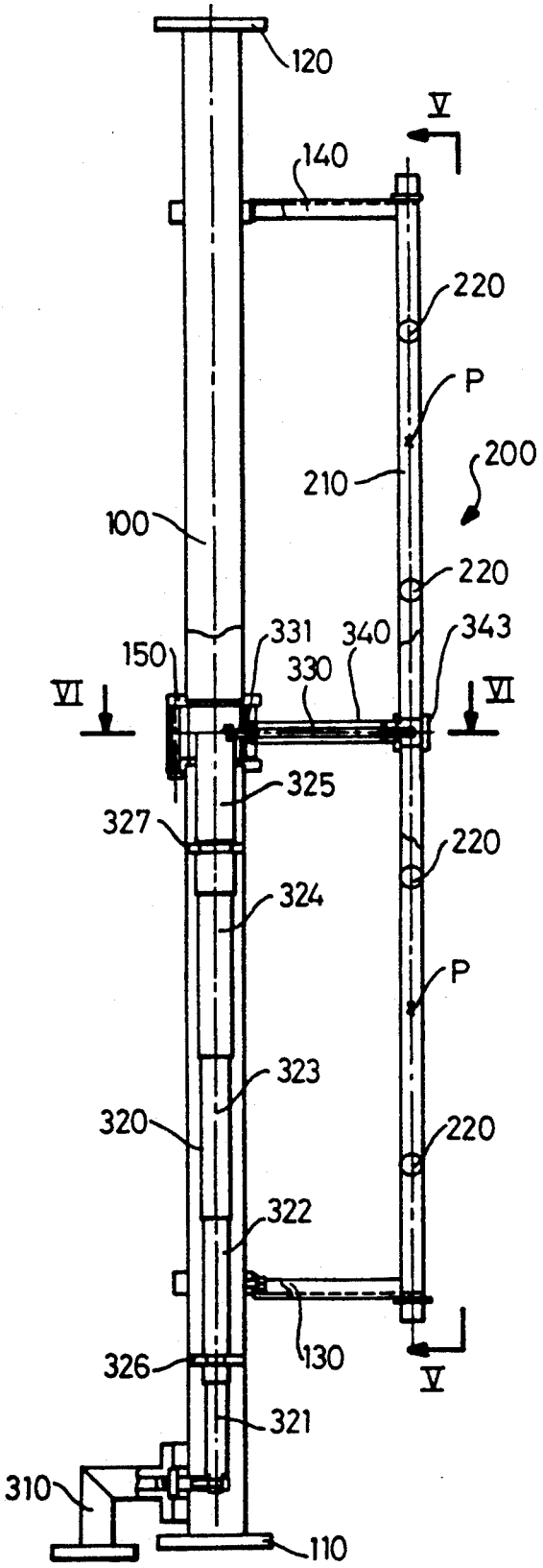
FIG. 4 shows a view in elevation, in partial cross-section, of the radiating set of FIG. 1.

FIG. 1 shows the general structure of a radiating set forming the antenna according to the invention: this set essentially has a central supporting tube 100 which is vertical and provided, at the lower and upper parts, with fastening plates, 110 and 120 respectively, enabling the end to end assembly of several superimposed supporting tubes and, therefore, a plurality of identical radiating sets, in order to increase the total radiated power.

Around this supporting tube, at 120 degrees with respect to each other, there are three identical radiating networks 200, each having a bifilary vertical line with two parallel conductors 210, 210' supporting a plurality of horizontal dipoles 220, 220' (4 in the example shown) evenly distributed along this bifilary line.

The radio-electrical supply, which is conveyed to 310 by a coaxial cable reaching the base of the antenna (hence in a zone which will hardly disturb the radiation diagram) goes (while remaining in the coaxial mode) inside the supporting tube 120 and is then distributed (still in coaxial mode) to each of the three radiating networks, going within a horizontal tube 340 mounted at mid-height on the central tube 100, which also provides for the mechanical support of these radiating networks in combination with the supporting arms 130, 140 at the top and bottom parts.

As will be seen, the supply and distribution of radio electrical energy is entirely internal to the structure of the antenna, thus eliminating any possibility of disturbance of the diagram, owing to the physical presence of supply lines in the field of radiation, as in the case of prior art antennas.

Characteristically, the antennas do not have any reflecting panels.

To increase the radiated power, it is possible to superimpose (FIG. 2) a plurality of modules 10 each formed by a radiating set 11 similar to the one shown in FIG. 1 and supplied by a coaxial cable 12 connected to a distributor at the bottom part of the antenna, and a cylindrical shielding radome 13. The set is placed at the tip of a mast 14, the upper module being closed by a lid 5 and, if necessary, surmounted by a lightning conductor (not shown) as is well known.

The radome 13, (FIGS. 2 and 3) is a cylinder made of reinforced polyester provided, at each of its ends, with rings 16, 17, designed for the joining of the different superimposed modules, thus enabling the creation of a self-supported radome, and thus greatly simplifying the mechanical construction. The entire system is, of course, drip-proof.

Figure 5:
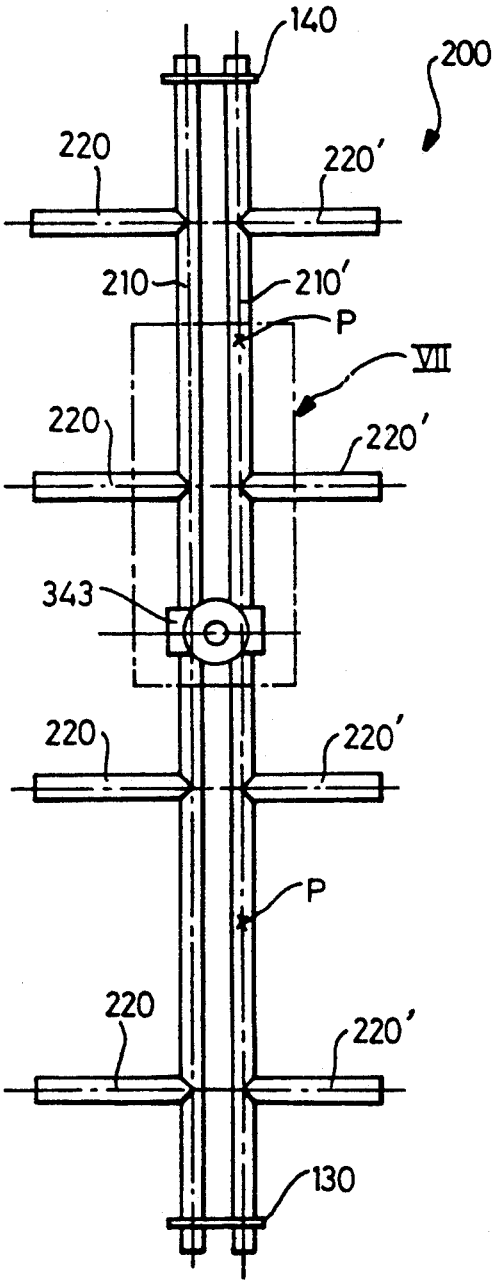
FIG. 5 is a front view, along the direction V—V of FIG. 4, of one of the three radiating networks included in this radiating set.
Figure 6:
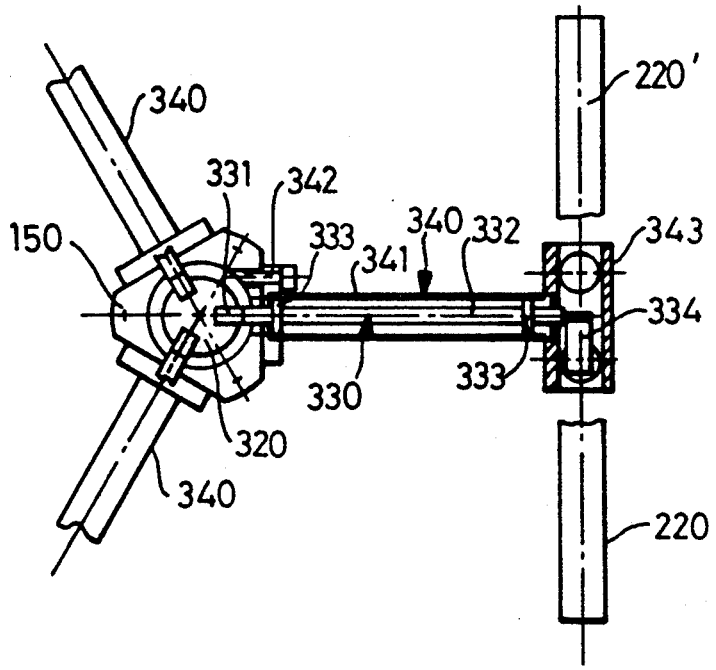
FIG. 6 is a top view, in a section along the line VI—VI of FIG. 4, showing the detail of the first section of the coaxial supply cable of the radiating network.

FIGS. 4 to 6 give a more detailed description of the structure of the radiating set according to the invention, notably for the supply of the three networks of dipoles.

The radio-electrical supply system, connected at 310, is taken up to mid-height of the central tube 100, inside it, by a coaxial line 320 (the return conductor is formed by the very wall of the supporting tube) comprising several sections 321 to 325 with increasing diameters, forming a quarter-wave impedance transformer, and held centrally in the supporting tube 100 by straps 326, 327.

The supply is then distributed among the three radiating networks by equiphase, equal-power distribution, again by a coaxial link.

The coaxial link 330, 340, supplying each of the radiating networks is formed (FIG. 6) by a conductor 332, held within a tube 341 by straps 333 with one of its ends 331 connected to the central common line 320.

Figure 7:
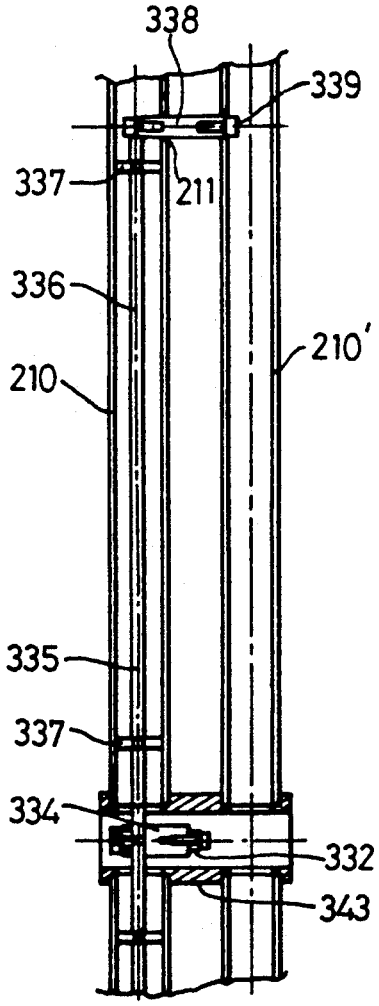
FIG. 7 is a frontal view, in section, corresponding to the region marked VII in FIG. 5, giving a more detailed view of one of the two arms forming the second section of this coaxial supply cable.

This tube 341 is both the return conductor of the coaxial line and a mechanical support connecting the radiating network to the central supporting tube. To this effect, this tube 341 is provided, at one of its ends, with a link 342 to a part 150 solidly joined to the central tube and, at its other end, with a part 343 supporting the two conductors 210, 210' of the bifilary line which extend on either side of this part 343 (FIG. 7) and are formed by hollow tubes made of conductive material, for example fixed by brazing.

The core 332 of the coaxial line is then connected to a distributor element 334 which symmetrically supplies the upper and lower branches of one of the conductors (in the drawing, the conductor 210') of the bifilary line, the other conductor (the conductor 210) being connected to the common ground.

For this, the core of the coaxial tube extends into the conductor 210 up to a point 339 located approximately at mid-height on each of the two arms namely, the upper and lower arms (this point 339, which will be the excitation point of the bifilary line, is marked P in FIGS. 4 and 5).

To this effect, there is provision, between this point 339 and the distributor 334, for a conductor made of two sections 335, 336 with increasing diameters so as to act as an impedance transformer, these two sections being held within the conductor 210 by straps 337. The end of the supply line then goes through the conductor 210 at 211 to excite the conductor 210' at 339 by means of a transversal connecting part 338.

Thus, as can be seen, the supply is entirely coaxial from the input connector 310 up to the excitation point P, said coaxial supply system being furthermore, entirely contained within the bearing structure of the antenna (which therefore plays a dual mechanical and electrical role).

The bifilary line has a plurality of dipoles 220, 220' which are thus supplied symmetrically and form the radiating elements proper of the antenna.

The dipoles 220, 220' used are of the shortened half-wave type, computed on the central operating frequency of the antenna with a shortening coefficient of about 0.9.

The distance between two consecutive superimposed dipoles is as one shortened half-wave, computed for the central operating frequency of the antenna with a shortening coefficient of about 0.85.

The distance from the dipoles to the central axis of the system is one-quarter wave, non-shortened, computed for the central operating frequency of the antenna.

The impedance brought to the excitation point P, namely the connection of the bifilary lines supplying the dipoles, is 50 ohms, the supply being done by the coaxial lines for which a constant impedance of 50 ohms is preserved through the system of quarter-wave line transformers explained above.

It will be noted that the ends of the bifilary line correspond to intensity nodes and can be grounded directly by the straps 130, 140, further providing for the mechanical maintenance of the set.

The set can be made of copper or copper alloy tubing and may be joined by brazing, thus making the mechanical construction very simple.

From the electrical point of view, the antenna thus made thus consists of four superimposed rings (such as those seen in FIG. 3) each formed by three dipoles, placed horizontally at 120 degrees with respect to one another on all three sides of an equilateral triangle, and powered in with equal power.

Figure 8:
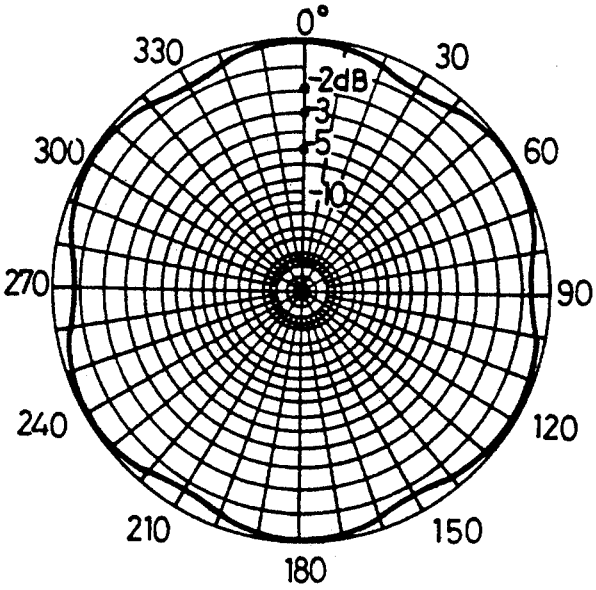
FIG. 8 is an azimuthal diagram plotted for an antenna according to the invention showing the omnidirectional nature of its diagram.

A configuration such as this gives, without the help of any reflector, an almost omni-directional diagram, as can be seen in FIG. 8, which shows an azimuthal diagram which is plotted for an antenna with an element such as the one shown in FIGS. 4 to 7 and has just been described, computed for a central operating frequency of 520 MHz. As can be seen, the diagram is omni-directional to within 0.9 dB.

Figure 9:
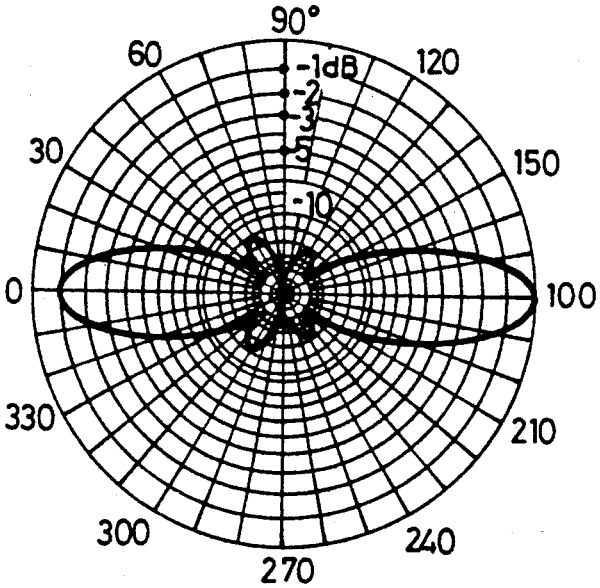
FIG. 9 is the elevational diagram corresponding to this same antenna.

FIG. 9 shows the elevation diagram, the shape of which is absolutely suited to a radio or television broadcasting antenna.

With respect to electrical performances, it has been noted that the antenna can be used to radiate power of the order of 5 to 7 kW without any damage, this power being, of course, greatly increased by superimposing several identical radiating sets.

The impedance, as indicated above, is 50 ohms, and the gain of 5 dB is the mean standing waves ratio of 1.15.

With respect to the mechanical performance characteristics, for antennas working in the 460–860 MHz band, the radiating sets are enclosed in radomes with a diameter of 0.54 m. and a height of 1.16 m. having a windward area of 0.63 $m^2$ (compared with a windward area of the order 1.35 $m^2$ for an antenna working in the same range, but made of antenna panels as described in the introduction to the present description), and a complete module (radome plus radiating sets) with a mass of about 40 kg (as compared with 375 kg in the example of an antenna with panels).

The choice wherein the network of dipoles are assembled in groups of three is not restrictive, but is especially advantageous.

For, if the number of networks is increased, the adjacent ends of the dipoles of one and the same ring will be increasingly close to one another, thus increasing their mutual coupling and accentuating the troughs in the diagram.

Figure 10:
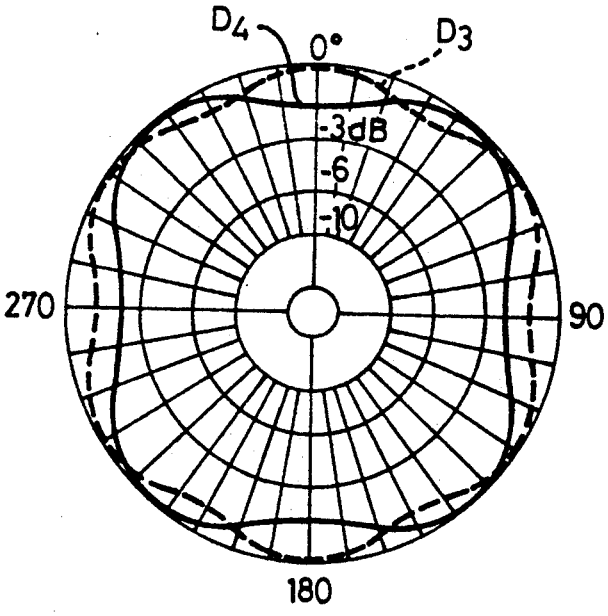
FIG. 10 is a comparison of the azimuthal diagrams available for two similar antennas, one of which has two radiating networks, at 120 degrees (as in FIGS. 1 to 7) and the other has four radiating networks at 90 degrees.

FIG. 10 illustrates this phenomenon: it shows the azimuthal diagram $D_4$ plotted for a 4-network system to be compared with the diagram $D_3$ for the 3-network system which is the object of the present description. It is noted that the maximum troughs now have a value of at least 2 dB instead of 0.9 dB in the other case.

The approach using three networks is therefore the one that gives the most homogeneous diagram.

Finally, as a variant, the dipoles can be optimized by modifying their shape: instead of making them rectilinear and forming the three sides of an equilateral triangle extrinsic to the circle passing through the centers of the three bifilary lines (the configuration of FIG. 3), the dipoles may be deformed or curved so as to bring them close to the contour of this circle or even fit them to this contour (the shape shown with broken lines in FIG. 3).

This improvement reduces radiation phase shifts between the different points of the dipole, and thus makes the diagram azimuthally even more omni-directional.

What is claimed is:

1. An omnidirectional antenna, for the emission of television or radio broadcast signals in the decimetric waveband, comprising:

a vertical central supporting tube;

a plurality of horizontal tubes symmetrically mounted at mid-height of said vertical central supporting tube, each horizontal tube having an inner end connected to said vertical central supporting tube;

a plurality of vertical bifilary lines, each bifilary line having two ends, each bifilary line comprising two parallel lines, each bifilary line connected to and supported by an outer end of one of the horizontal tubes;

a plurality of dipoles evenly distributed along the length of each bifilary line;

a first means for transporting signals to be broadcast up through the center of the vertical central supporting tube;

a second means for transporting and symmetrically distributing said signals to be broadcast from the center of the vertical central supporting tube to the vertical bifilary lines, coupled to the first means for transporting, passing through the horizontal tubes and coupled to the vertical bifilary lines; and wherein each vertical bifilary line and dipoles connected thereto define a radiating network; and wherein the second means comprises a coaxial line disposed inside one of the parallel lines of a corresponding bifilary line of the plurality of bifilary lines, said coaxial line electrically connects to the corresponding bifilary line at locations halfway between the center and the two ends of the corresponding bifilary line to provide signals to the corresponding bifilary line.

2. An antenna according to claim 1 wherein there are exactly three vertical bifilary lines.

3. An antenna according to claim 1, wherein each bifilary line comprises exactly four horizontal dipoles.

4. An antenna according to claim 1, wherein the dipoles are of the half-wave type whose length is equal to a half central working wavelength shortened by applying a shortening coefficient of about 0.9.

5. An antenna according to claim 1, wherein a distance between two consecutive dipoles is equal to a half wavelength computed from the central working frequency of the antenna and multiplied by a shortening coefficient of about 0.85.

6. An antenna according to claim 1, wherein the distance from the dipoles to said vertical central supporting tube is equal to a quarter wavelength of the central working frequency of the antenna.

7. An antenna according to claim 1, wherein the first means for transporting signals is entirely housed within the central supporting tube.

8. An antenna according to claim 1, wherein each dipole is curved so as to fit the contour o a circle passing through the center of the bifilary lines.

9. An omnidirectional antenna according to claim 1, further comprising a radome enclosing the central supporting tube, the plurality of horizontal tubes, the plurality of vertical bifilary lines, the plurality of dipoles, the first means and the second means, wherein said radome is substantially self-supporting and stackable.

10. An antenna according to claim 1, wherein:

dipoles of said plurality of dipoles evenly distributed along the length of each vertical bifilary line are vertically distributed.

11. An antenna according to claim 1, further comprising:

a horizontal support arm means, for supporting one of said bifilary lines.

12. A radiating system formed by a plurality of omnidirectional antenna for emission of television or radio broadcast signals in a decimetric waveband, comprising:

a plurality of antenna structurally supported by a single vertical central support tube, wherein all the antennas are disposed at different heights;

a plurality of coaxial supply lines inside the central supporting tube, each coaxial supply line corresponding to one of said plurality of antennas and supplying that corresponding antenna with a signal;

each antenna comprising a plurality of horizontal tubes symmetrically mounted to said vertical central support tube at a first height, each horizontal tube having an inner end connected to said central support tube, a plurality of vertical bifilary lines, each bifilary line having two ends, each bifilary line comprising two parallel lines, each bifilary line connected to and supported by an outer end of one of the horizontal tubes, a plurality of dipoles evenly distributed along the length of each bifilary line, a first means, including one of the plurality of coaxial supply lines, for transporting signals to be broadcast up through the center of the single vertical central support tube, a second means for transporting and symmetrically distributing said signal to be broadcast from the center of the vertical central support tube to the plurality of vertical bifilary lines, coupled to the first means for transporting, passing through the horizontal tubes and coupled to the bifilary lines, and wherein each bifilary line and dipoles connected thereto define a radiating network; and wherein the second means comprises a coaxial line disposed inside one of the parallel lines of a corresponding bifilary line of the plurality of bifilary lines, said coaxial line electrically connects to the corresponding bifilary line at locations halfway between the center and the two ends of the corresponding bifilary line to provide signals to the corresponding bifilary line.

* * * * *